US011056065B2

(12) United States Patent
Hwang et al.

(10) Patent No.: US 11,056,065 B2
(45) Date of Patent: Jul. 6, 2021

(54) LIGHT-EMITTING DISPLAY FOR COMPENSATING DEGRADATION OF ORGANIC LIGHT-EMITTING DIODE AND METHOD OF DRIVING THE SAME

(71) Applicant: LG Display Co., Ltd., Seoul (KR)

(72) Inventors: Yiyeon Hwang, Paju-si (KR); Jongsin Park, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/712,904

(22) Filed: Dec. 12, 2019

(65) Prior Publication Data

US 2020/0193918 A1 Jun. 18, 2020

(30) Foreign Application Priority Data

Dec. 17, 2018 (KR) ..... 10-2018-0163453

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2320/045* (2013.01)

(58) Field of Classification Search
CPC ..... G09G 2300/0426; G09G 2320/045; G09G 2330/021; G09G 2330/12; G09G 3/3225; G09G 3/3266; G09G 3/3291
See application file for complete search history.

(56) References Cited

U.S. PATENT DOCUMENTS

2013/0050292 A1* 2/2013 Mizukoshi ..... G09G 3/3291 345/690
2016/0012798 A1* 1/2016 Oh ..... G09G 3/325 345/205
2016/0086544 A1* 3/2016 Park ..... G09G 3/3266 345/690
2017/0025061 A1* 1/2017 Takizawa ..... G09G 3/3291
2017/0067957 A1* 3/2017 Lee ..... G01R 31/2635
2017/0249882 A1* 8/2017 Lee ..... G09G 3/3241
2017/0249899 A1* 8/2017 Xiang ..... G09G 3/3233
2017/0249904 A1* 8/2017 Li ..... G09G 3/3233
2017/0372656 A1* 12/2017 Furukawa ..... G09G 3/3266
2018/0020525 A1* 1/2018 Moon ..... G09G 3/3233
2018/0061913 A1* 3/2018 Kim ..... H01L 27/3244
(Continued)

FOREIGN PATENT DOCUMENTS

KR 10-2011-0032937 A 3/2011
KR 10-2017-0050749 A 5/2017
(Continued)

*Primary Examiner* — Chun-Nan Lin
(74) *Attorney, Agent, or Firm* — Seed IP Law Group LLP

(57) ABSTRACT

The present disclosure provides a light-emitting display including a display panel, a first circuit, a second circuit, and a compensation circuit. The display panel includes a pixel having an organic light-emitting diode. The first circuit supplies a data voltage to the pixel. The second circuit performs a first sensing operation for sensing a voltage stored at an anode of the organic light-emitting diode and a second sensing operation for sensing a parasitic capacitance of the organic light-emitting diode. The compensation circuit compensates for degradation of the organic light-emitting diode based on a sensed value outputted from the second circuit.

10 Claims, 18 Drawing Sheets

(56) References Cited

U.S. PATENT DOCUMENTS

| | | | | |
|---|---|---|---|---|
| 2018/0240399 | A1* | 8/2018 | Lin | G09G 3/32 |
| 2019/0035335 | A1* | 1/2019 | Kim | G09G 3/3291 |
| 2019/0305730 | A1* | 10/2019 | Huang | G09G 3/006 |

FOREIGN PATENT DOCUMENTS

| | | | |
|---|---|---|---|
| KR | 10-2017-0080776 | A | 7/2017 |
| KR | 10-2018-0067106 | A | 6/2018 |

* cited by examiner

| Vdata | Vs |
|---|---|
| EVDD + 0.5 | 5.5001 |
| EVDD + 1 | 5.5606 |
| EVDD + 1.5 | 5.5914 |
| EVDD + 2 | 5.6254 |
| EVDD + 2.5 | 5.6543 |
| EVDD + 3 | 5.6792 |
| EVDD + 3.5 | 5.7009 |
| EVDD + 4 | 5.7202 |

Ex) EVDD=6

LIGHT-EMITTING DISPLAY FOR COMPENSATING DEGRADATION OF ORGANIC LIGHT-EMITTING DIODE AND METHOD OF DRIVING THE SAME

CROSS-REFERENCE TO RELATED APPLICATION(S)

This application claims the benefit of Korean Patent Application No. 10-2018-0163453, filed Dec. 17, 2018, which is incorporated herein by reference for all purposes as if fully set forth herein.

BACKGROUND

Technical Field

The present disclosure relates to a light-emitting display and a method of driving the same.

Description of the Related Art

The market for display devices which act as an intermediary between users and information is growing with the development of information technology. Thus, display devices such as organic light-emitting displays (OLED), quantum dot displays (QDP), and liquid-crystal displays (LCD) or other types of displays are being increasingly used.

Some of the aforementioned display devices include a display panel including sub-pixels, a drive part that outputs driving signals for driving the display panel, and a power supply part that generates electric power to be supplied to the display panel or drive part.

When driving signals, for example, a scan signal and a data signal, are supplied to sub-pixels of the display panel, the aforementioned display devices are able to display an image by allowing the selected sub-pixels to pass light therethrough or to emit light by themselves.

Notably, the light-emitting displays offer many advantages, including electrical and optical characteristics, such as fast response time, high brightness, and wide viewing angle, and mechanical characteristics such as flexibility.

BRIEF SUMMARY

On top of the advantages that the light-emitting displays have, the display device according to the present disclosure further provides a compensation circuit having an improved configuration. The compensation circuit can compensate for degraded characteristics in the organic light-emitting diode to improve the lifespan of the display device, enhance light emission efficiency, effectively detect degraded pixels within the display panel, accurately sense an amount of degradation of the organic light-emitting diode, precisely compensating for the amount of degradation, and other various effects readily derivable from the circuit.

In one or more embodiments, the present disclosure provides a light-emitting display including a display panel, a first circuit, a second circuit, and a compensation circuit. The display panel includes a pixel having an organic light-emitting diode. The first circuit supplies a data voltage to the pixel. The second circuit performs a first sensing operation for sensing a voltage stored at an anode of the organic light-emitting diode and a second sensing operation for sensing a parasitic capacitance of the organic light-emitting diode. The compensation circuit compensates for degradation of the organic light-emitting diode based on a sensed value outputted from the second circuit.

In one or more embodiments, the present disclosure provides a method of driving a light-emitting display. The method includes: sensing a voltage stored at an anode of an organic light-emitting diode included in a pixel; sensing a parasitic capacitance of the organic light-emitting diode; and compensating for degradation of the organic light-emitting diode, based on the sensed voltage and the sensed parasitic capacitance.

In one or more embodiments, the present disclosure provides a method of sensing a degradation degree of a light-emitting diode within a display device. The method includes: detecting a voltage of an anode of the light-emitting diode at an output terminal of an amplifier, the amplifier having an integrating capacitor between the output terminal and an input terminal of the amplifier; charging a parasitic capacitor of the light emitting diode through a driving transistor connected to the anode of the light emitting diode; and sensing a charge accumulated in the integrating capacitor moved from the charge of the parasitic capacitor at the output terminal of the amplifier.

BRIEF DESCRIPTION OF THE SEVERAL VIEWS OF THE DRAWINGS

The accompany drawings, which are included to provide a further understanding of the disclosure and are incorporated on and constitute a part of this specification illustrate embodiments of the disclosure and together with the description serve to explain the principles of the disclosure.

DETAILED DESCRIPTION

Figure 1:
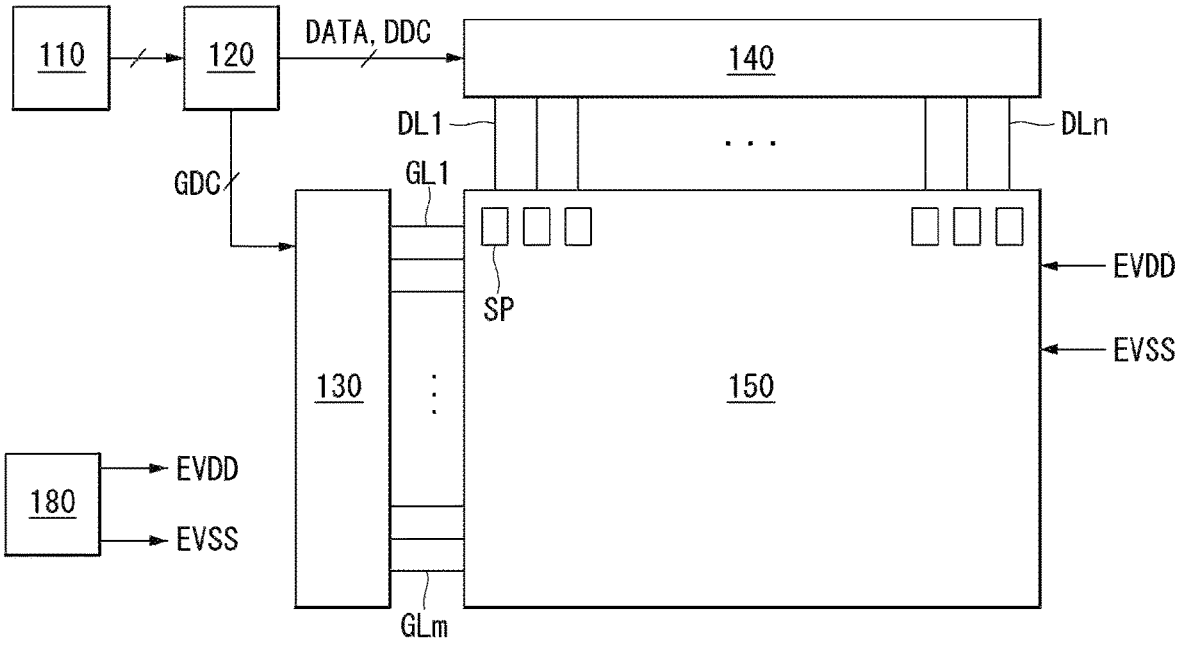
FIG. 1 is a schematic block diagram of an organic light-emitting display according to one or more embodiments of the present disclosure.

Reference will now be made in detail embodiments of the disclosure examples of which are illustrated in the accompanying drawings.

Hereinafter, concrete embodiments of the present disclosure will be described with reference to the accompanying drawings.

A light-emitting display according to the present disclosure may be implemented in televisions, video game players, personal computers (PCs), home theater systems, automotive electronics, smartphones, smart watches, wearable devices, flexible display devices and so forth, but are not limited to them.

Moreover, a light-emitting display to be described below is applicable to an inorganic light-emitting display device using inorganic light-emitting diodes, as well as an organic light-emitting display device using organic light-emitting diodes. By way of example, the following description will be given of an organic light-emitting display device.

The organic light-emitting display device to be described below performs an image display operation and an external compensation operation. The external compensation operation may be performed for each sub-pixel or for each pixel. The external compensation operation may be performed during a vertical blanking interval in the image display operation, during a power-on sequence before the start of the image display operation, or during a power-off sequence after the end of the image display operation.

The vertical blanking interval is the time during which no data signals for image display are written, between each vertical active period during which 1 frame of data signals is written. The power-on sequence is a transition period from turning on the power for driving the device until displaying an image. The power-off sequence is a transition period from the end of display of an input image until turning off the driving power.

In an external compensation method for performing the external compensation operation, a driving transistor may be operated in a source-follower manner, and then the voltage (e.g., the source voltage of the driving TFT) stored in a line capacitor (e.g., parasitic capacitor) of a sensing line may be sensed. In the external compensation method, the source voltage may be sensed when the potential at the source node of the driving transistor goes into a saturated state (e.g., the current Ids of the driving TFT becomes zero), in order to compensate for variation in the threshold voltage of the driving transistor. Also, in the external compensation method, linear values may be sensed before the source node of the driving transistor reaches saturation, in order to compensate for variation in the mobility of the driving transistor.

Moreover, in the external compensation method, a current flowing through a sensing node defined between the source node of the driving transistor and the anode of the organic light-emitting diode may be sensed, in order to compensate for variation in the threshold voltage of the driving transistor. In addition, the charge accumulated in the parasitic capacitor of the organic light-emitting diode may be sensed, in order to compensate for degradation of the organic light-emitting diode. In some embodiments, the term "parasitic capacitor" may refer to a parasitic capacitance of an element such as a conductive line or the organic light-emitting diode, as opposed to a separate element. However, in other embodiments, it may refer to a separate capacitor. As above, in the external compensation method, the voltage stored in a line or electrode, the current flowing through a node, and the charge accumulated in the parasitic capacitor may be sensed, and degradation of an element included in the sub-pixel may be compensated for based on the sensed values.

In addition, although sub-pixels to be described below will be illustrated as including n-type thin-film transistors by way of example, they may include p-type thin-film transistors or both the n-type and p-type transistors. A thin-film transistor is a three-electrode device with gate, source, and drain. The source is an electrode that provides carriers to the transistor. The carriers in the thin-film transistor flow from the source. The drain is an electrode where the carriers leave the thin-film transistor. That is, the carriers in the thin-film transistor flow from the source to the drain.

In the case of the n-type thin-film transistor, the carriers are electrons, and thus the source voltage is lower than the drain voltage so that the electrons flow from the source to the drain. In the n-type thin-film transistor, current flows from the drain to the source. In contrast, in the case of the p-type thin-film transistor, the carriers are holes, and thus the source voltage is higher than the drain voltage so that the holes flow from the source to the drain. In the p-type thin-film transistor, since the holes flow from the source to the drain, current flows from the source to the drain. However, the source and drain of a thin-film transistor are interchangeable depending on the applied voltage. In this regard, in the description below, either the source or drain will be referred to as a first electrode and the other will be referred to as a second electrode.

Figure 2:
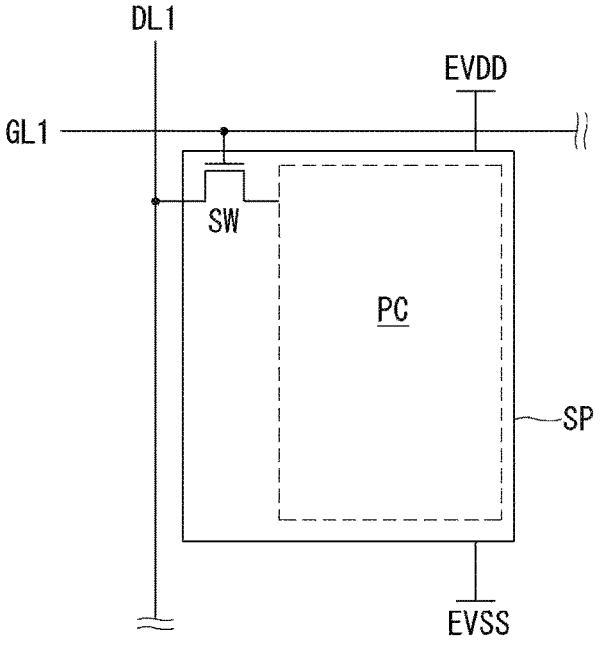
FIG. 2 is a schematic view of the configuration of a sub-pixel shown in FIG. 1.

FIG. 1 is a schematic block diagram of an organic light-emitting display according to one or more embodiments of the present disclosure. FIG. 2 is a schematic view of the configuration of a sub-pixel shown in FIG. 1.

As shown in FIGS. 1 and 2, the organic light-emitting display according to the exemplary embodiment of the present disclosure comprises an image providing part 110, a timing controller 120, a scan driver 130, a data driver 140, a display panel 150, and a power supply part 180. In one or more embodiments, the term "part" used herein may be broadly construed to be a circuit, a module of an electronic system, a subsystem or a system implemented using electronic circuitry, one or more functioning unit structures of a larger system, or the like. In other embodiments, the term "part" can be used as the meaning as used in the context of each embodiments of the present disclosure.

The image providing part 110 (or host system) outputs various driving signals, along with a video data signal supplied from the outside or a video data signal stored in an internal memory. The image providing part 110 may supply a data signal and various driving signals to the timing controller 120.

The timing controller 120 outputs a gate timing control signal GDC for controlling the operation timing of the scan driver 130, a data timing control signal DDC for controlling the operation timing of the data driver 140, and various synchronization signals (e.g., a vertical synchronization signal Vsync and a horizontal synchronization signal Hsync).

The timing controller 120 supplies the data driver 140 with a data signal DATA supplied from the image providing part 110, along with a data timing control signal DDC. The timing controller 120 may be formed in the form of an IC (integrated circuit) and mounted on a printed circuit board, but is not limited thereto.

In response to the gate timing control signal GDC supplied from the timing controller 120, the scan driver 130 outputs a scan signal (e.g., scan voltage). The scan driver 130 supplies a scan signal to sub-pixels included in the display panel 150 through scan lines GL1 to GLm. The scan driver 130 may be formed in the form of an IC or directly on the display panel 150 by the gate-in-panel (GIP) technology, but is not limited thereto.

In response to the data timing control signal DDC supplied from the timing controller 120, the data driver 140 samples and latches the data signal DATA, converts it to an analog data voltage corresponding to a gamma reference voltage, and outputs the analog data voltage.

The data driver 140 supplies the data voltage to sub-pixels included in the display panel 150 through data lines DL1 to DLm. The data driver 140 may be formed in the form of an IC and mounted on the display panel 150 or on a printed circuit board, but is not limited thereto.

The power supply part 180 generates and outputs a high-potential first voltage or power EVDD and a low-potential second voltage or power EVSS based on an external input voltage supplied from the outside. The power supply part 180 may generate and output a voltage (e.g., scan-high voltage or scan-low voltage) utilized to run the scan driver 130 or a voltage (e.g., drain voltage or half-drain voltage) utilized to run the data driver 140, as well as the first and second voltages EVDD and EVSS.

The display panel 150 displays an image, corresponding to the driving signals including the scan signal and data voltage outputted from the drive part or drive circuitry including the scan driver 130 and data driver 140, and the first and second voltages EVDD and EVSS outputted from the power supply part 180. The sub-pixels of the display panel 150 emit light directly.

The display panel 150 may be fabricated based on a rigid or flexible substrate of glass, silicon, polyimide, or the like. The sub-pixels which emit light may include red, green, and blue pixels, or may include red, green, blue, and white pixels.

For example, each sub-pixel SP may include a pixel circuit PC which includes a switching transistor SW, a driving transistor DT, a storage capacitor Cst, and an organic light-emitting diode OLED, etc. The sub-pixels used in the organic light-emitting display may have a relatively complex circuit configuration since they emit light by themselves. Also, there are various compensation circuits that compensate for degradation of the organic light-emitting diodes, which emit light, and degradation of the driving transistors, which supply a driving current to the organic light-emitting diodes. As such, it should be noted that the pixel circuit PC in each sub-pixel SP may be represented in block form, as various different circuitry may be included in different forms of the pixel circuit PC in accordance with various embodiments of the present disclosure.

Although, in the above description, the timing controller 120, scan driver 130, data driver 140, etc., are described as if they were individual components, one or more among the timing controller 120, scan driver 130, and data driver 140 may be integrated in one IC depending on the method of implementation of the organic light-emitting display.

Figure 3:
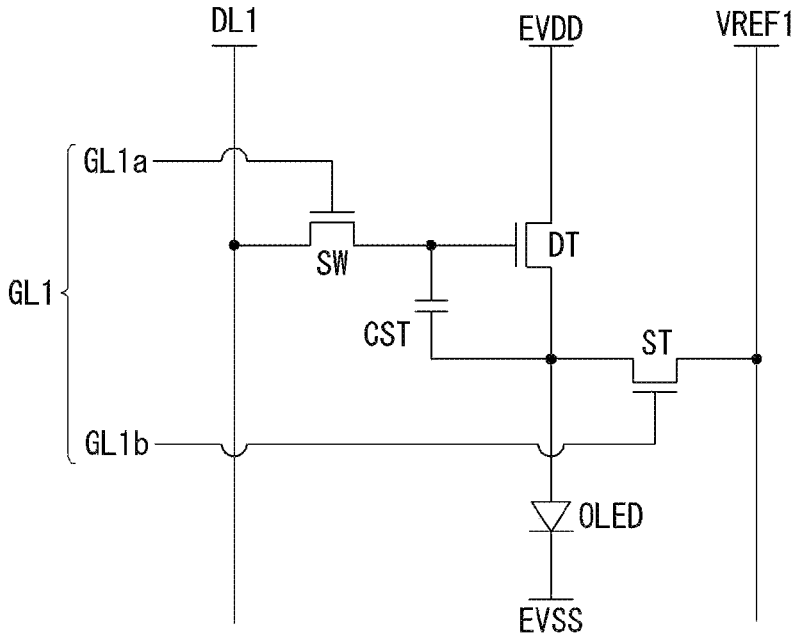
FIG. 3 is a circuit diagram showing a sub-pixel comprising a compensation circuit according to one or more embodiments of the present disclosure.
Figure 4:
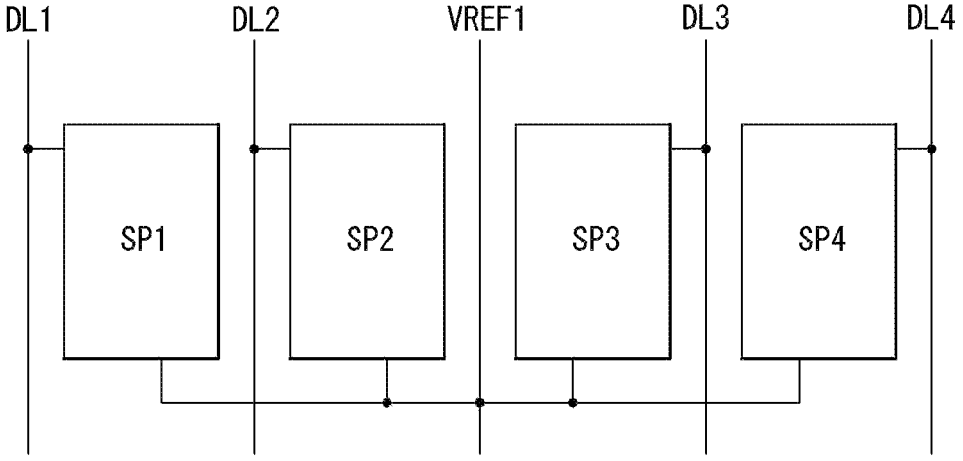
FIGS. 4 and 5 are schematic views illustrating a pixel that can be implemented based on the sub-pixel of FIG. 3, according to one or more embodiments of the present disclosure.
Figure 5:
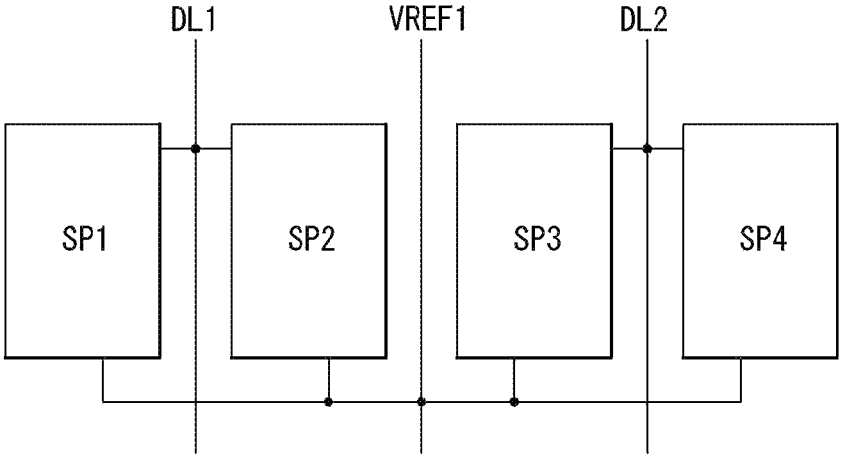

FIG. 3 is a circuit diagram showing a sub-pixel comprising a compensation circuit according to one or more embodiments of the present disclosure. FIGS. 4 and 5 are schematic views of a pixel that can be implemented based on the sub-pixel of FIG. 3.

As shown in FIG. 3, a sub-pixel comprising a compensation circuit according to the exemplary embodiment of the present disclosure includes a switching transistor SW, a sensing transistor ST, a driving transistor DT, a capacitor CST, and an organic light-emitting diode OLED.

A gate electrode of the switching transistor SW is connected to a first (or 1A) scan line GL1*a*, a first electrode thereof is connected to a first data line DL1, and a second electrode thereof is connected to a gate electrode of the driving transistor DT. The gate electrode of the driving transistor DT is connected to the capacitor CST, a first electrode thereof is connected to a first power supply line EVDD, and a second electrode thereof is connected to an anode of the organic light-emitting diode OLED.

A first electrode of the capacitor CST is connected to the gate electrode of the driving transistor DT, and a second electrode thereof is connected to the anode of the organic light-emitting diode OLED. The anode of the organic light-emitting diode OLED is connected to the second electrode of the driving transistor DT, and a cathode thereof is connected to a second power supply line EVSS.

A gate electrode of the sensing transistor ST is connected to a second (or 1B) scan line GL1*b*, a first electrode thereof is connected to a first sensing line VREF1, and a second electrode thereof is connected to the anode, which is a sensing node, of the organic light-emitting diode OLED. The sensing transistor ST is included in or utilized as part of a compensation circuit to sense degradation, threshold voltage, etc., in the driving transistor DT and organic light-emitting diode OLED. The sensing transistor ST obtains a sensed value through a sensing node defined between the driving transistor DT and the organic light-emitting diode OLED. The sensed value obtained from the sensing transistor ST is delivered to an external compensation circuit provided outside the sub-pixel through the first sensing line VREF1.

The 1A scan line GL1*a* connected to the gate electrode of the switching transistor SW and the 1B scan line GL1*b* connected to the gate electrode of the sensing transistor ST may be separated from each other as shown in the drawing, or may be connected together. For example, in some embodiments, the 1A scan line GL1*a* and the 1B scan line GL1*b* may be a same scan line that is connected to the gate electrodes of both the switching transistor SW and the sensing transistor ST. Connecting the gate electrodes together can reduce the number of scan lines, and, as a result, prevent a decrease in aperture ratio caused by the addition of a compensation circuit.

As shown in FIGS. 4 and 5, first to fourth sub-pixels SP1 to SP4 each including a compensation circuit according to one or more embodiments of the present disclosure may form one pixel. The first to fourth sub-pixels SP1 to SP4 may be configured to emit light in red, green, blue, and white, respectively, but are not limited thereto. However, in other embodiments, different numbers of sub-pixels can form a single pixel.

As in the first example of FIG. 4, the first to fourth sub-pixels SP1 to SP4 each comprising a compensation circuit may be connected to share one sensing line, e.g., the first sensing line VREF1, and may be connected separately to the first to fourth data lines DL1 to DL4, respectively.

As in the second example of FIG. 5, the first to fourth sub-pixels SP1 to SP4 each comprising a compensation circuit may be connected to share one sensing line, e.g., the first sensing line VREF1, and may be connected in pairs to one data line. For example, the first and second sub-pixels SP1 and SP2 may share the first data line DL1, and the third and fourth sub-pixels SP3 and SP4 may share the second data line DL2.

However, FIGS. 4 and 5 show only two examples, and the present disclosure may be applicable to a display panel that has sub-pixel structures different than those illustrated and explained above. Furthermore, the present disclosure is also applicable to a structure having a compensation circuit within a sub-pixel or a structure having no compensation circuit within a sub-pixel.

Figure 6:
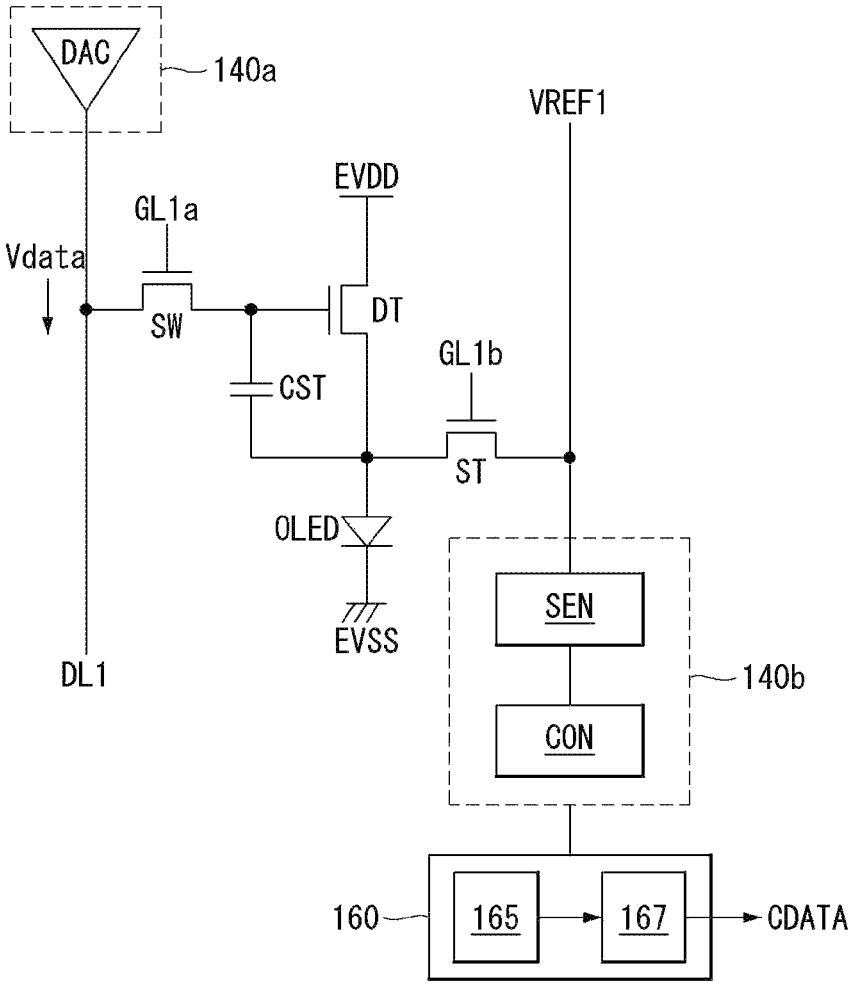
FIG. 6 is a schematic diagram illustrating a first example of blocks of an organic light-emitting display, separately, according to one or more embodiments of the present disclosure.
Figure 7:
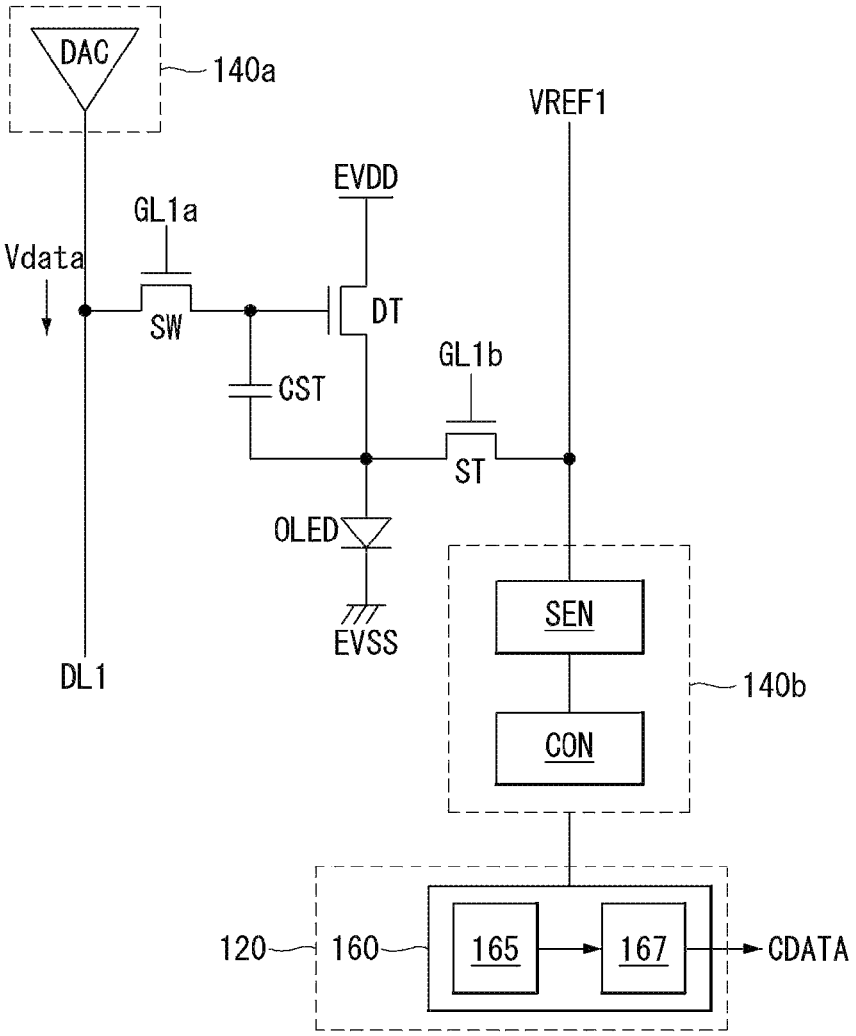
FIGS. 7 and 8 are schematic diagrams illustrating a second example of blocks of an organic light-emitting display, separately, according to one or more embodiments of the present disclosure.
Figure 8:
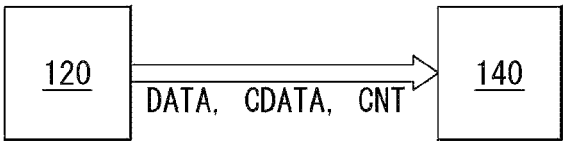
Figure 9:
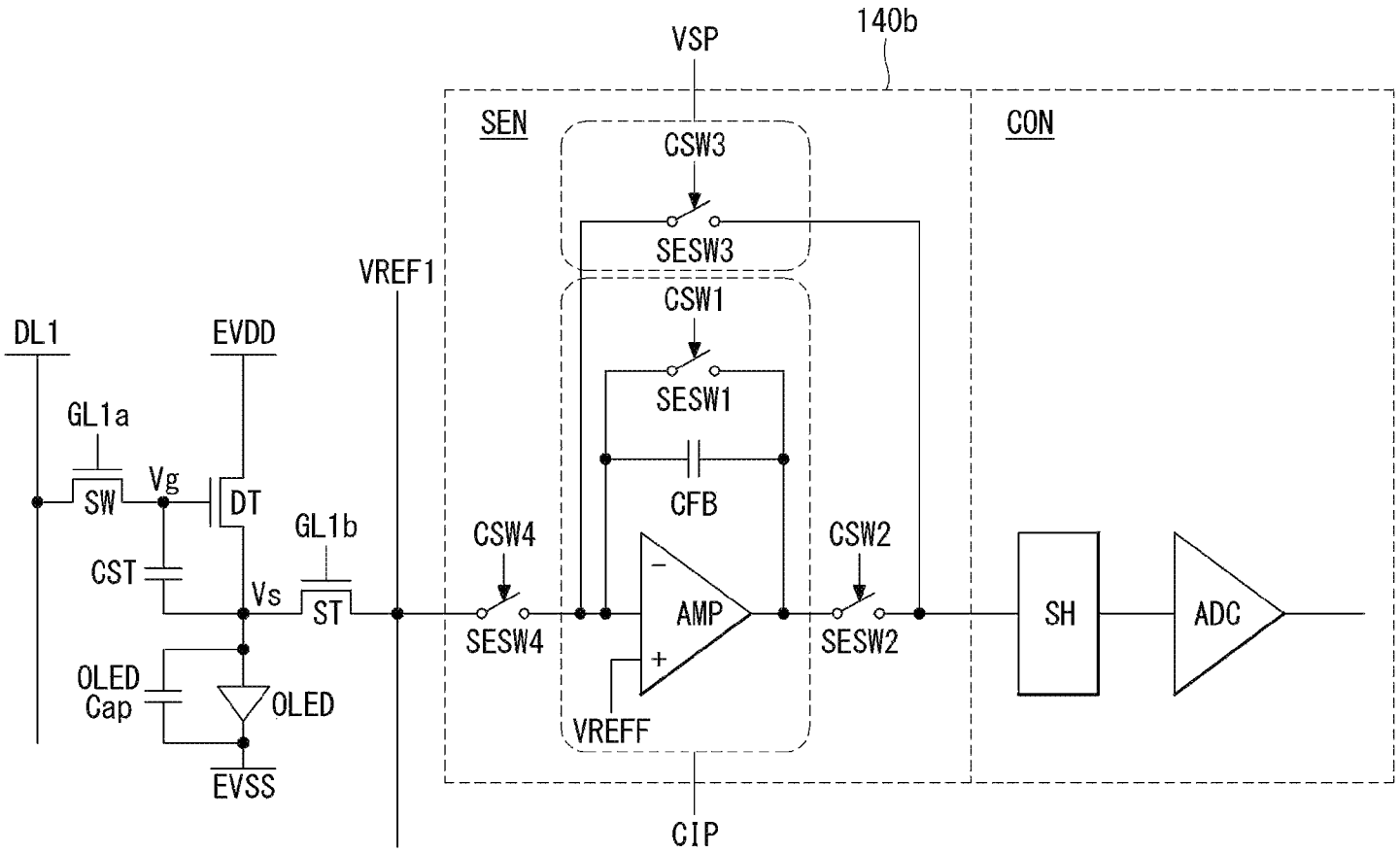
FIG. 9 is a schematic diagram illustrating an example of a second circuit of an organic light-emitting display according to one or more embodiments of the present disclosure.

FIG. 6 is a schematic diagram showing a first example of blocks of an organic light-emitting display, separately, according to one or more embodiments of the present disclosure. FIGS. 7 and 8 are schematic diagrams showing a second example of blocks of an organic light-emitting display, separately, according to one or more embodiments of the present disclosure. FIG. 9 is a schematic diagram showing an example of a second circuit of an organic light-emitting display according to one or more embodiments of the present disclosure.

As shown in FIG. 6, the organic light-emitting display according to some embodiments of the present disclosure comprises a circuit that supplies a data voltage to a sub-pixel, senses an element or value included in the sub-pixel, and generates a compensation value based on the sensed value.

The data driver 140*a* and 140*b* is a circuit that performs a driving operation such as supplying a data voltage to the sub-pixel and a sensing operation for sensing an element included in the sub-pixel, and may comprise a first circuit 140*a* and a second circuit 140*b*. However, an external compensation circuit such as the second circuit 140*b* may be configured as a separate unit. For example, the second circuit 140*b* may be included as circuitry that is separate from the data driver 140 in some embodiments.

The first circuit 140*a* is a circuit that outputs a data voltage Vdata for the driving operation of the sub-pixel, which may comprise data voltage output circuitry DAC (which may be referred to herein as a data voltage output part DAC). The data voltage output part DAC converts a digital data signal supplied from the timing controller 120 to an analog voltage and outputs it. An output end of the data voltage output part DAC is connected to the first data line DL1. The data voltage output part DAC may output voltages (e.g., black voltage, etc.) utilized for compensation, as well as data voltages Vdata utilized for image representation. In some embodiments, the data voltage output part DAC may be a digital-to-analog converter.

The second circuit 140*b* is a circuit for sensing an element included in the sub-pixel, which may comprise a sensing circuit part SEN for obtaining a sensed value and a sensed value conversion circuit part CON for converting a sensed value. The sensing circuit part SEN may sense the characteristics of an element included in the sub-pixel through the first sensing line VREF1. In an example, the sensing circuit part SEN may sense the voltage stored in the line capacitor Vsen of the first sensing line VREF1 (e.g., parasitic capacitor formed along the first sensing line), and sense the characteristics of an element included in the sub-pixel. In another example, the sensing circuit part SEN may sense a current flowing through a sensing node connected to the first sensing line VREF1, and sense the characteristics of an element included in the sub-pixel based on the sensed current value. In yet another example, the sensing circuit part SEN may sense the charge accumulated in the parasitic capacitor of the organic light-emitting diode through the first sensing line VREF1, and sense the characteristics of an element included in the sub-pixel based on the sensed charge value. The sensed value conversion part CON may convert an analog sensed value outputted from the sensing circuit part SEN to a digital sensed value and output it.

A compensation circuit 160 is a circuit that produces a compensation value based on the sensed values, along with image analysis, which may comprise image analyzing circuitry 165 (which may be referred to herein as an image analyzer 165) and compensation value generation circuitry 167 (which may be referred to herein as a compensation value generator 167). The image analyzer 165 may analyze the sensed values outputted from the sensed value conversion part CON, as well as externally input data signals. The compensation value generator 167 may determine a degree or amount of degradation of a sensed element and generate a compensation value for compensation, corresponding to an analysis result outputted from the image analyzer 165.

As shown in FIGS. 7 and 8, if the first circuit 140*a* and the second circuit 140*b* are included inside the data driver 140, the compensation circuit 160 may be included inside the timing controller 120. Thus, the timing controller 120 may supply the data driver 130 with a compensated data signal CDATA, which is obtained by compensating a data signal DATA based on a compensation value, and which may be generated, for example, by the compensation circuit 160. Also, the timing controller 120 may supply the data driver 140 with a control signal CNT for controlling the first circuit 140*a* and the second circuit 140*b*.

As shown in FIG. 9, the second circuit 140*b* of the organic light-emitting display according to one or more embodiments of the present disclosure comprises a sensing circuit part SEN for obtaining a sensed value and a sensed value conversion part CON for converting a sensed value.

The sensed value conversion part CON comprises sample and hold circuitry SH (which may be referred to herein as a sample and hold part SH) and an analog-to-digital conversion circuit or part ADC. The sample and hold part SH samples and holds a sensed value outputted from the sensing circuit part SEN. The analog-to-digital conversion part ADC converts an analog sensed value outputted from the sample and hold part SH to a digital sensed value and outputs it. In some embodiments, the analog-to-digital conversion part ADC may be an analog-to-digital converter.

The sensing circuit part SEN comprises a first sensing switch or part SESW4, a second sensing switch or part SESW3, a sensed value delivery switch or part SESW2, a circuit initialization switch or part SESW1, an integrating capacitor CFB, and an operational amplifier (op-amp) AMP. The circuit initialization switch part SESW1, integrating capacitor CFB, and op-amp AMP in the sensing circuit part SEN are included in a first sensing circuit part CIP for sensing a current or charge through the first sensing line VREF1. The second sensing switch part SESW3 is included in a second sensing circuit part VSP for sensing a voltage through the first sensing line VREF1.

A gate electrode (or a switch electrode) of the first sensing switch part SESW4 is connected to a first sensing start signal line CSW4, a first electrode thereof is connected to the first sensing line VREF1, and a second electrode thereof is connected to an inverting terminal (−) of the op-amp AMP. A first electrode of the integrating capacitor CFB is connected to the inverting terminal (−) of the op-amp AMP, and a second electrode thereof is connected to an output terminal of the op-amp AMP.

A gate electrode of the circuit initialization switch part SESW1 is connected to a circuit initialization signal line CSW1, a first electrode thereof is connected to the inverting terminal (−) of the op-amp AMP, and a second electrode thereof is connected to the output terminal of the op-amp AMP. A non-inverting terminal (+) of the op-amp AMP is connected to a reference voltage source VREFF, and the output terminal of the op-amp AMP is connected to a first electrode of the sensed value delivery switch part SESW2.

A gate electrode of the sensed value delivery switch part SESW2 is connected to an output delivery signal line CSW2, a first electrode thereof is connected to the output terminal of the op-amp AMP, and a second electrode thereof is connected to an input terminal of the sample and hold part SH. A gate electrode of the second sensing switch part SESW3 is connected to a second sensing start signal line CSW3, a first electrode thereof is connected to a second electrode of the first sensing switch part SESW4, and a second electrode thereof is connected to the input terminal of the sample and hold part SH.

The circuit initialization switch part SESW1 turns on in response to a circuit reset signal applied through the circuit initialization signal line CSW1. When the circuit initialization switch part SESW1 is turned on, an integrated sensed value from the integrating capacitor CFB of the first sensing circuit part CIP is reset. The first sensing switch part SESW4 turns on in response to a current sensing start signal applied through the first sensing start signal line CSW4. When the first sensing switch part SESW4 is turned on, the first sensing circuit part CIP may measure and integrate a current or charge through the first sensing line VREF1. The measured current may be used as an index for determining degradation of the driving transistor DT. Likewise, the measured charge may be used as an index for determining a change in the parasitic capacitance OLED Cap of the organic light-emitting diode OLED.

The sensed value delivery switch part SESW2 turns on in response to a sensed value delivery signal applied through the output delivery signal line CSW2. When the sensed value delivery switch part SESW2 is turned on, an integrated sensed value from the first sensing circuit part CIP is delivered to the sample and hold part SH. Accordingly, the sensed value delivery switch part SESW2 operates to selectively output sensed values to the sample and hold part SH. The second sensing switch part SESW3 turns on in response to a second sensing start signal applied through the second sensing start signal line CSW3. When the first sensing switch part SESW4 and the second sensing switch part SESW3 are turned on together, the voltage stored in the anode of the organic light-emitting diode OLED may be measured. The measured voltage may be used as an index for determining a change in the voltage at the anode of the organic light-emitting diode OLED.

Figure 10:
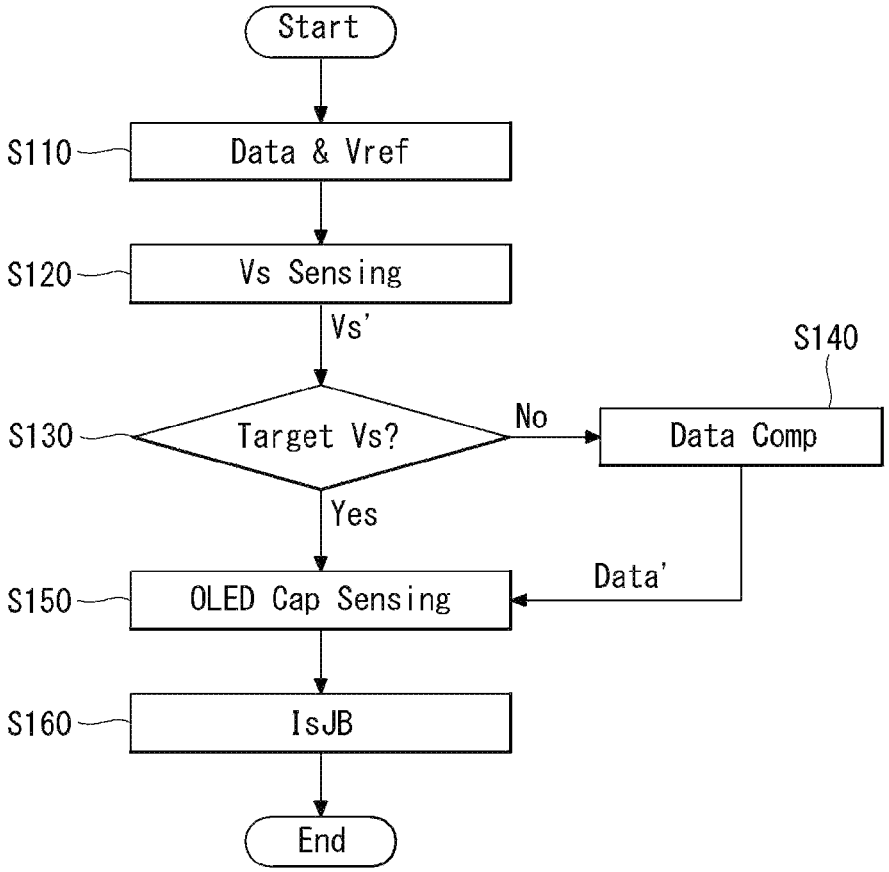
FIG. 10 is a flowchart for explaining a method of driving an organic light-emitting display according to one or more embodiments of the present disclosure.
Figure 11:
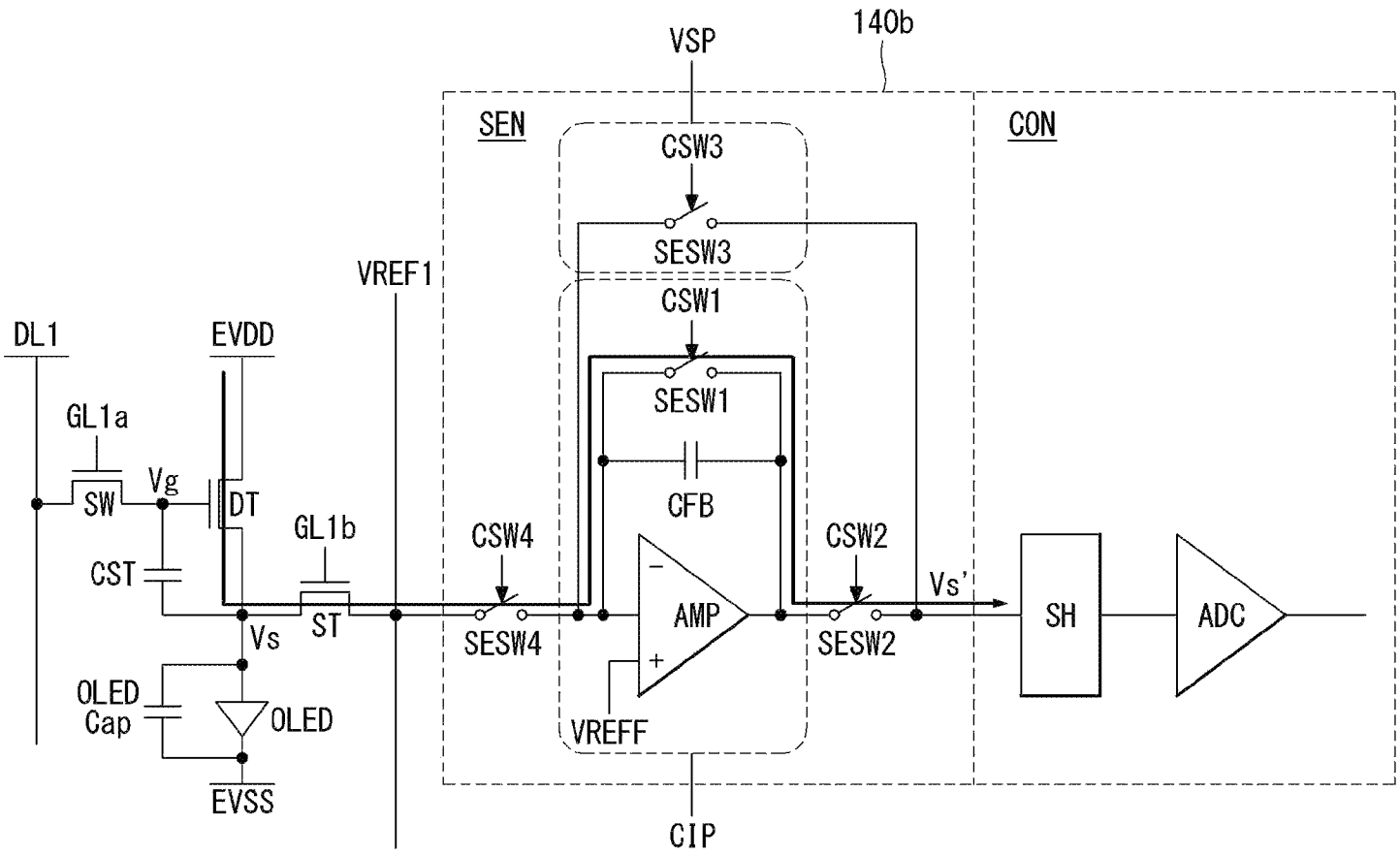
FIGS. 11 and 12 are views for explaining a first sensing operation according to one or more embodiments of the present disclosure.
Figure 12:
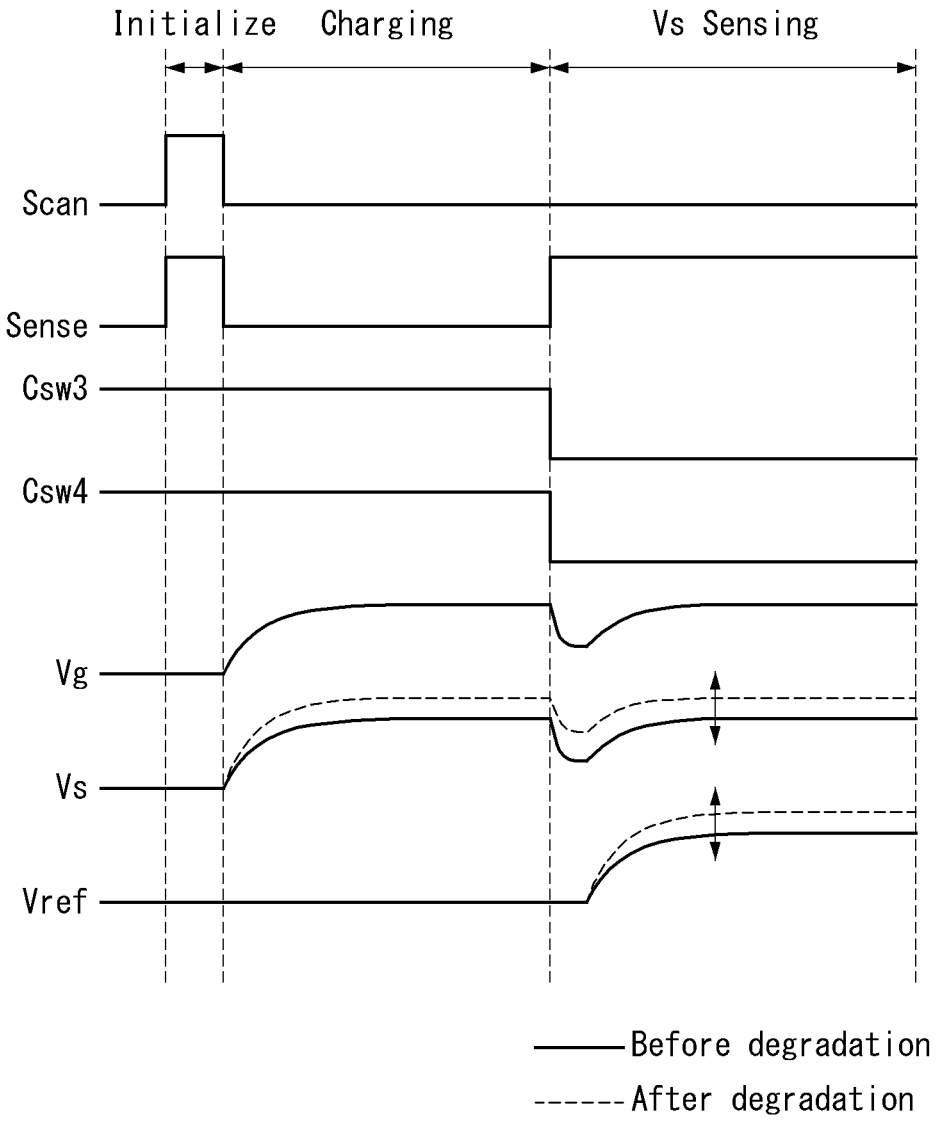
Figure 13:
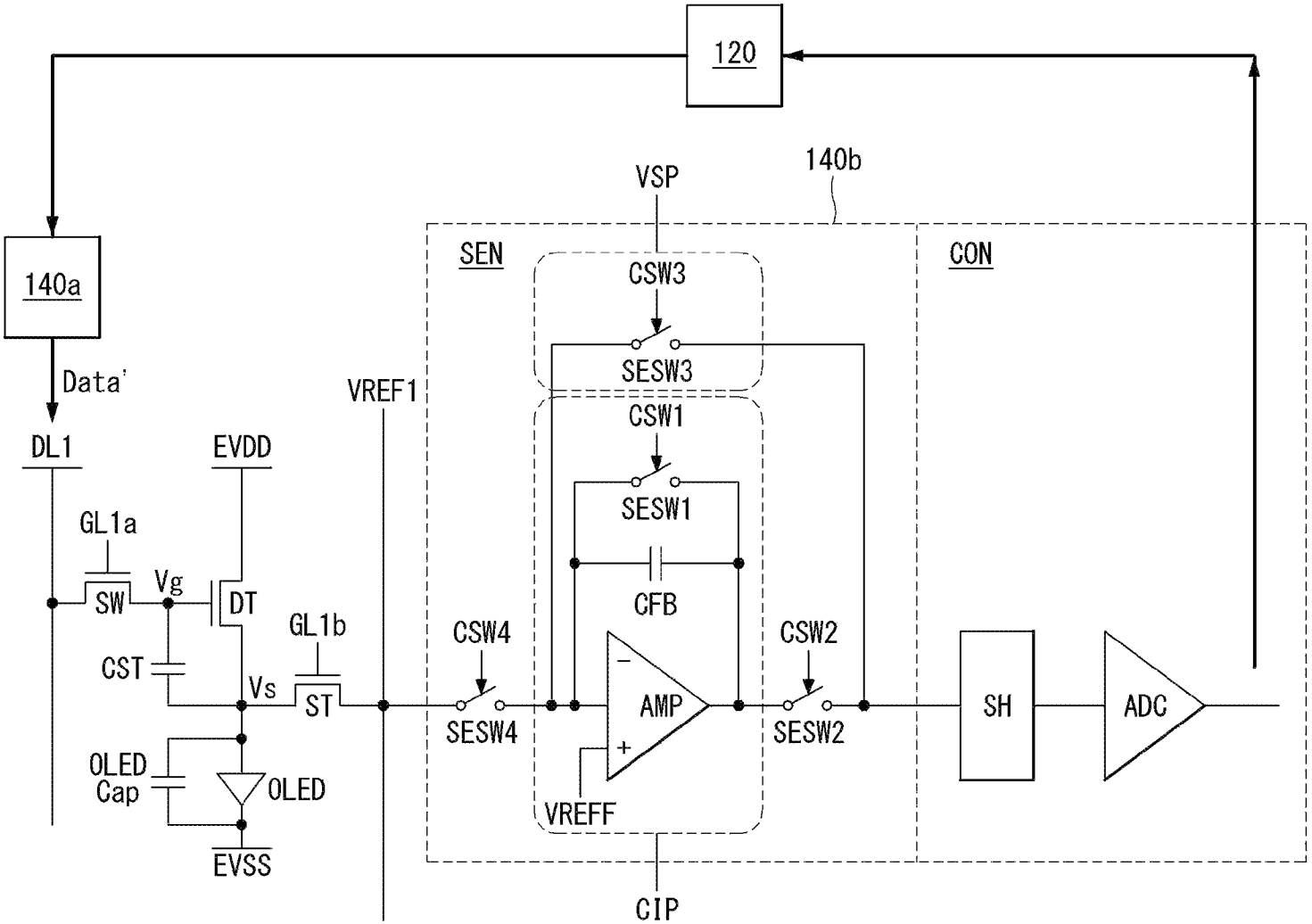
FIGS. 13 to 15 are views for explaining a data compensation process according to one or more embodiments of the present disclosure.
Figure 14:
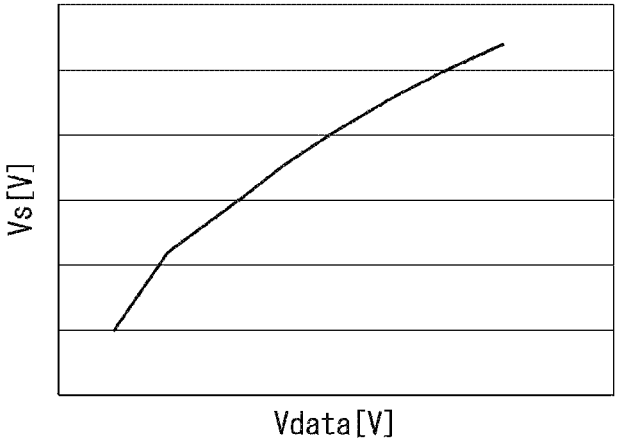
Figure 15:
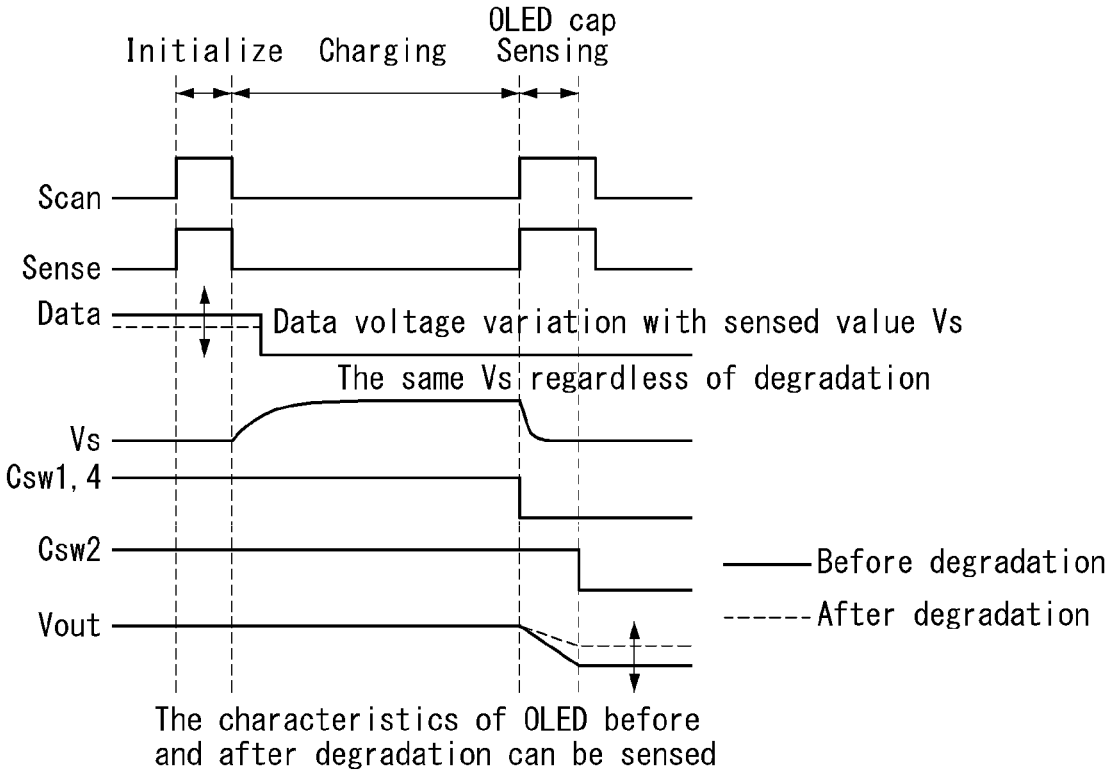
Figure 16:
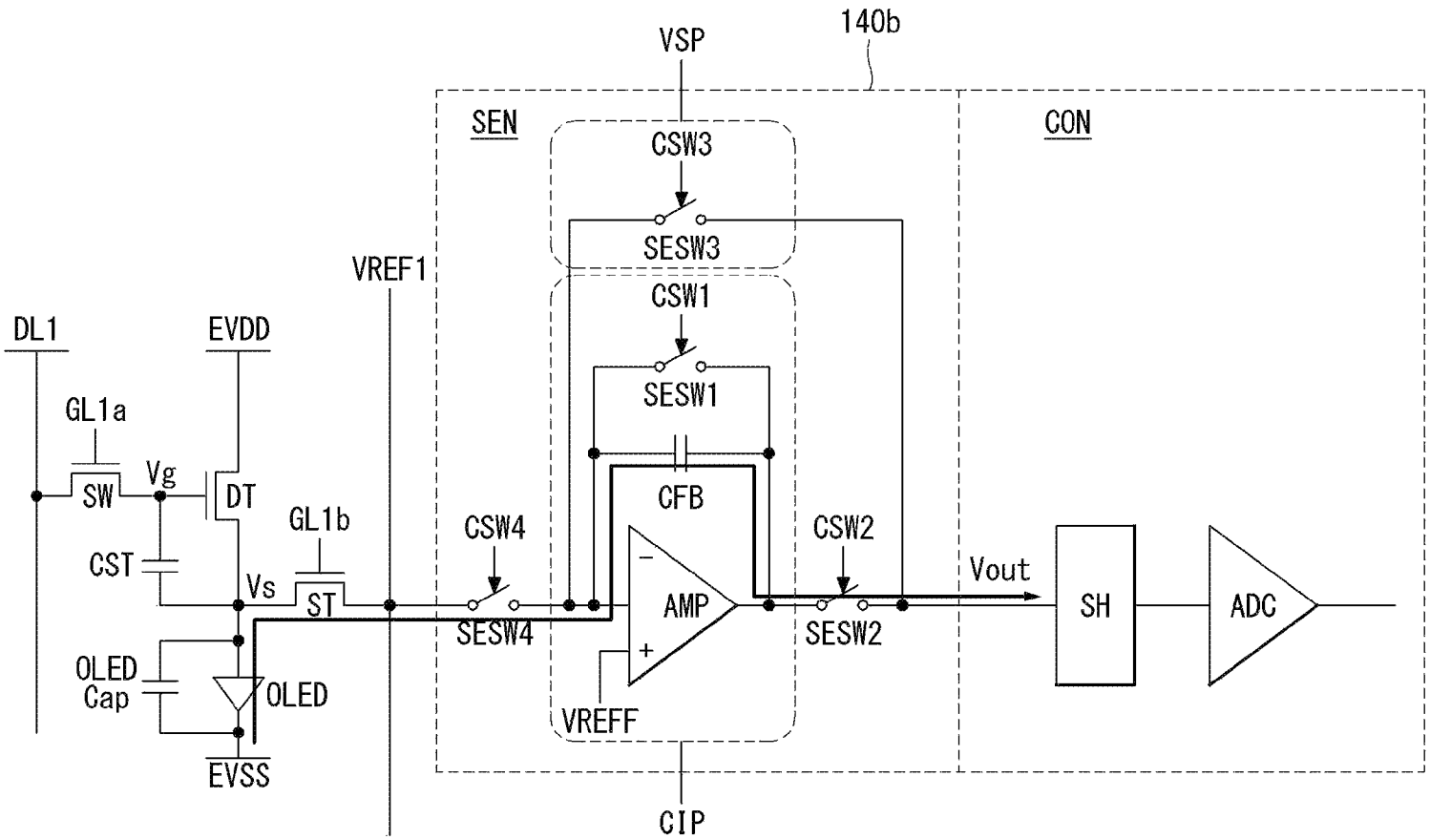
FIGS. 16 to 19 are views for explaining a second sensing operation according to one or more embodiments of the present disclosure.
Figure 20:
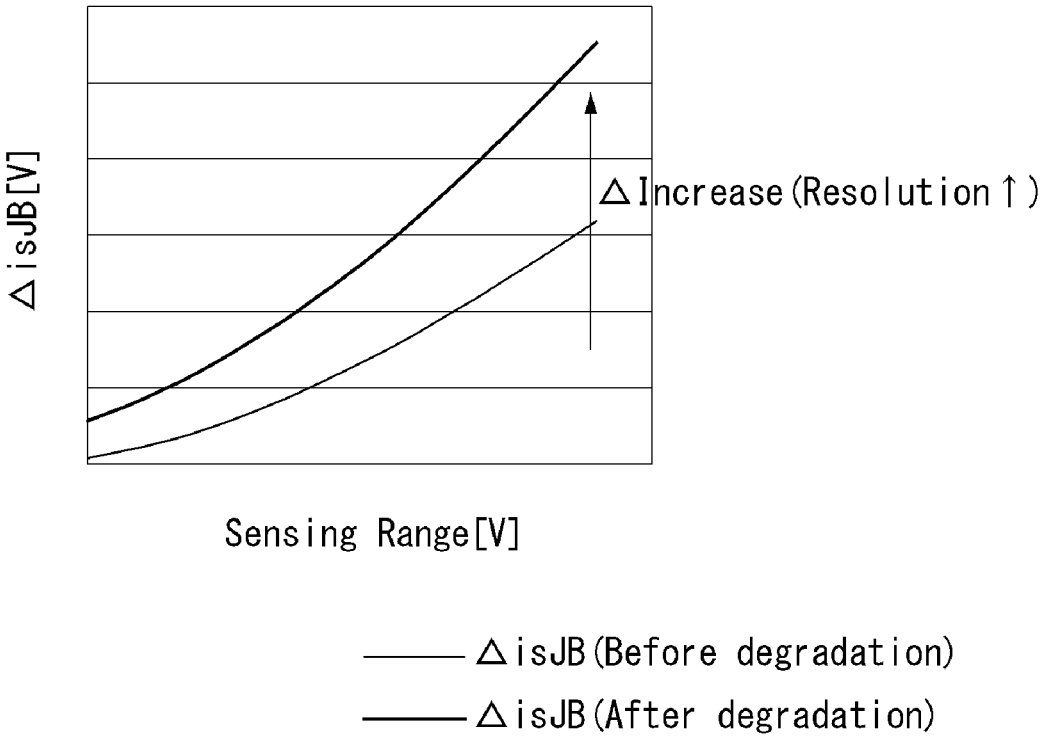
FIGS. 20 and 21 are views for explaining advantages of a compensation method according to one or more embodiments of the present disclosure.
Figure 21:
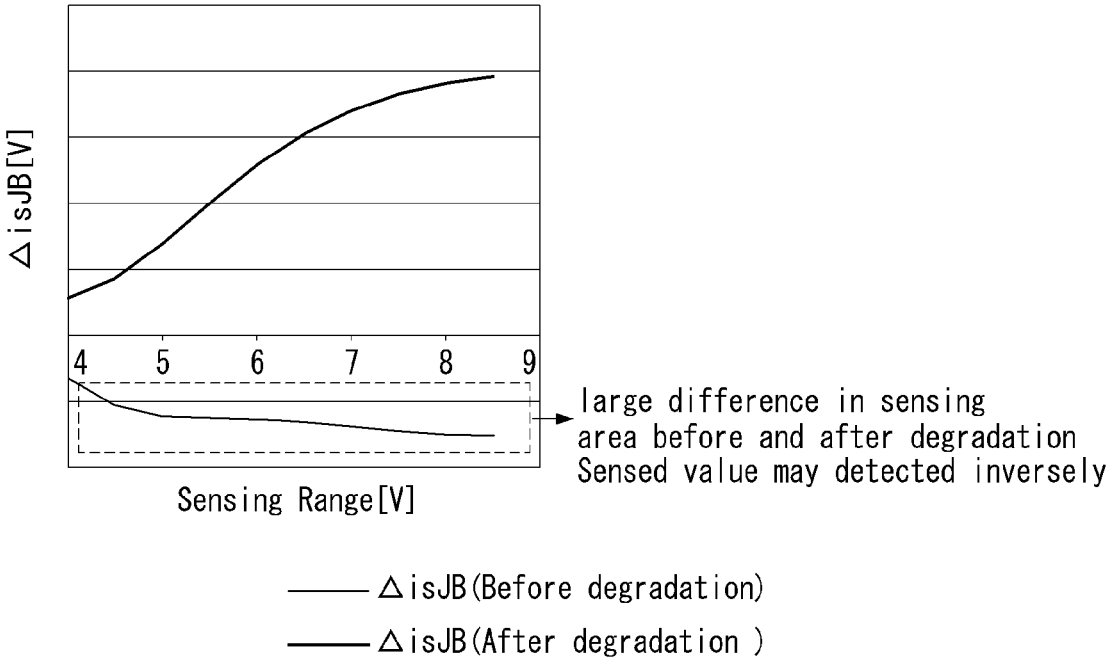

FIG. 10 is a flowchart for explaining a method of driving an organic light-emitting display according to one or more embodiments of the present disclosure. FIGS. 11 and 12 are views for explaining a first sensing operation according to one or more embodiments of the present disclosure. FIGS. 13 to 15 are views for explaining a data compensation process according to one or more embodiments of the present disclosure. FIGS. 16 to 19 are views for explaining a second sensing operation according to one or more embodiments of the present disclosure. FIGS. 20 and 21 are views for explaining advantages of a compensation method according to one or more embodiments of the present disclosure.

An organic light-emitting display according to one or more embodiments of the present disclosure provides a device and method of accurately sensing an amount of degradation of the organic light-emitting diode and precisely compensating for the amount of degradation. Hereinafter, example embodiments of the present disclosure will be described in further details with reference to FIGS. 10 to 21.

As shown in FIGS. 10 and 11, a sensing data voltage Data is applied through the first data line DL1 and a reference voltage Vref (or sensing voltage) is applied through the first sensing line VREF1 (S110), and then the voltage at a sensing node is sensed (Vs Sensing) (S120). Referring further to FIG. 12, the step S110 and S120 of applying and sensing voltage comprises an initialization step (Initialize), a charging step (Charging), and a voltage sensing step (Vs Sensing).

During the initialization step (Initialize), the switching transistor SW and the sensing transistor ST are turned on by a logic-high scan signal Scan and a sense signal Sense, which may be applied to the 1A gate line GL1*a* and the 1B gate line GL1*b*, respectively. In this step, the switching transistor SW is turned on, and the driving transistor DT is turned on by the sensing data voltage Data stored in the capacitor CST and generates a drive current. In this instance, the first sensing switch part SESW4 and the second sensing switch part SESW3 are turned off by a logic-high first sensing start signal Csw4 and a second sensing start signal Csw3.

During the charging step (Charging), the switching transistor SW and the sensing transistor ST are turned off by a logic-low scan signal Scan and a sense signal Sense. In this step, the gate voltage Vg and source voltage Vs of the driving transistor DT are stored as they rise based on the applied voltage. In this instance, the first sensing switch part SESW4 and the second sensing switch part SESW3 remain turned-off by the logic-high first sensing start signal Csw4 and the second sensing start signal Csw3.

During the voltage sensing step (Vs Sensing), the switching transistor SW is turned off by the logic-low scan signal Scan, but the sensing transistor ST is turned on by the logic-high sense signal Sense. In this instance, the first sensing switch part SESW4 and the second sensing switch part SESW3 switch to the turned-on state by the logic-low first sensing start signal Csw4 and the second sensing start signal Csw3. As a result, the voltage Vref across the first sensing line VREF1 is stored as it rises in response to the source voltage Vs of the driving transistor DT. In this step, the source voltage Vs of the driving transistor DT is sensed by the turned-on first sensing switch part SESW4 and second sensing switch part SESW3, and sampled by the sample and hold part SH. Here, Vs' denotes the current source voltage Vs' (changed source voltage) which is a variation of the previous source voltage Vs.

The source voltage Vs' measured through the first sensing line VREF1 may be used as an index for determining a voltage change at the anode of the organic light-emitting diode OLED. A variation of the voltage at the anode of the organic light-emitting diode OLED (see the voltage change before and after degradation in FIG. 12) indicates degradation of the organic light-emitting diode OLED.

As shown in FIGS. 10 and 13, the sensed source voltage Vs' is analyzed to see whether it corresponds to a target source voltage (Target Vs) (S130). The sensed source voltage Vs' is sampled by the sample and hold part SH, passes through the analog-to-digital conversion part ADC, and is delivered to the timing controller 120 where a compensation circuit is present. If the sensed source voltage Vs' does not correspond to the target source voltage (Target Vs? No), the sensed data voltage is compensated for (Data Comp) to apply a compensated sensing data voltage Data' (S140). The compensation circuit of the timing controller 120 may compare the sensed source voltage Vs' to the target source voltage using, for example, a comparator or comparison circuitry, a lookup table or any suitable methodology or technique for determining whether the sensed source voltage Vs' corresponds to the target source voltage, and in some cases, for determining an amount of difference between the sensed source voltage Vs' and the target source voltage.

In this step, the timing controller 120 may determine through the analysis of the source voltage Vs' whether the organic light-emitting diode OLED is degraded or not. Also, if the sensed source voltage Vs' does not correspond to the target source voltage (Target Vs), the timing controller 120 generates a compensated sensing data signal and supplies the compensated sensing data signal to the data driver. The compensated sensing data signal may be a data signal suitable to compensate for degradation of the OLED in order to adjust the sensed source voltage Vs' to a level which corresponds with the target source voltage. Then, the first circuit 140*a* of the data driver generates a compensated sensing data voltage Data' corresponding to the compensated sensing data signal, and outputs it through the first data line DL1. As such, if the sensed source voltage Vs' does not correspond to the target source voltage (Target Vs), this means that the organic light-emitting diode OLED is degraded compared to how it was previously.

Referring further to FIG. 14, if the source voltage Vs' is higher than the target source voltage Vs, the level of the sensing data voltage Data may be lowered in response to the target source voltage Vs, whereby a compensated sensing data voltage Data' may be applied. In this case, the sensing data voltage may be compensated for by using a look-up table, but is not limited thereto.

If the source voltage Vs' is different from the target source voltage Vs, a sensing operation and an operation of varying the sensing data voltage may be repeated by varying the level of the sensing data voltage until the target source voltage Vs is reached. FIG. 14 is only an example of a graph and table that show the variation of source voltage Vs with sensing data voltage Data, assuming that first power EVDD of 6V is applied, in order to help understanding of an exemplary embodiment of the present disclosure, but the present disclosure is not limited thereto.

By contrast, if the source voltage Vs' corresponds to the target source voltage (Target Vs? Yes), the compensated sensing data voltage Data' is not generated, and the process proceeds to the step S150 of sensing the parasitic capacitance of the organic light-emitting diode OLED (OLED Cap Sensing). This is because there is no need to vary the sensing data voltage Data since the result of determination shows that the organic light-emitting diode OLED is not degraded. As such, if the sensed source voltage Vs' corresponds to the target source voltage (Target Vs), this means that the organic light-emitting diode OLED is not degraded.

Figure 19:
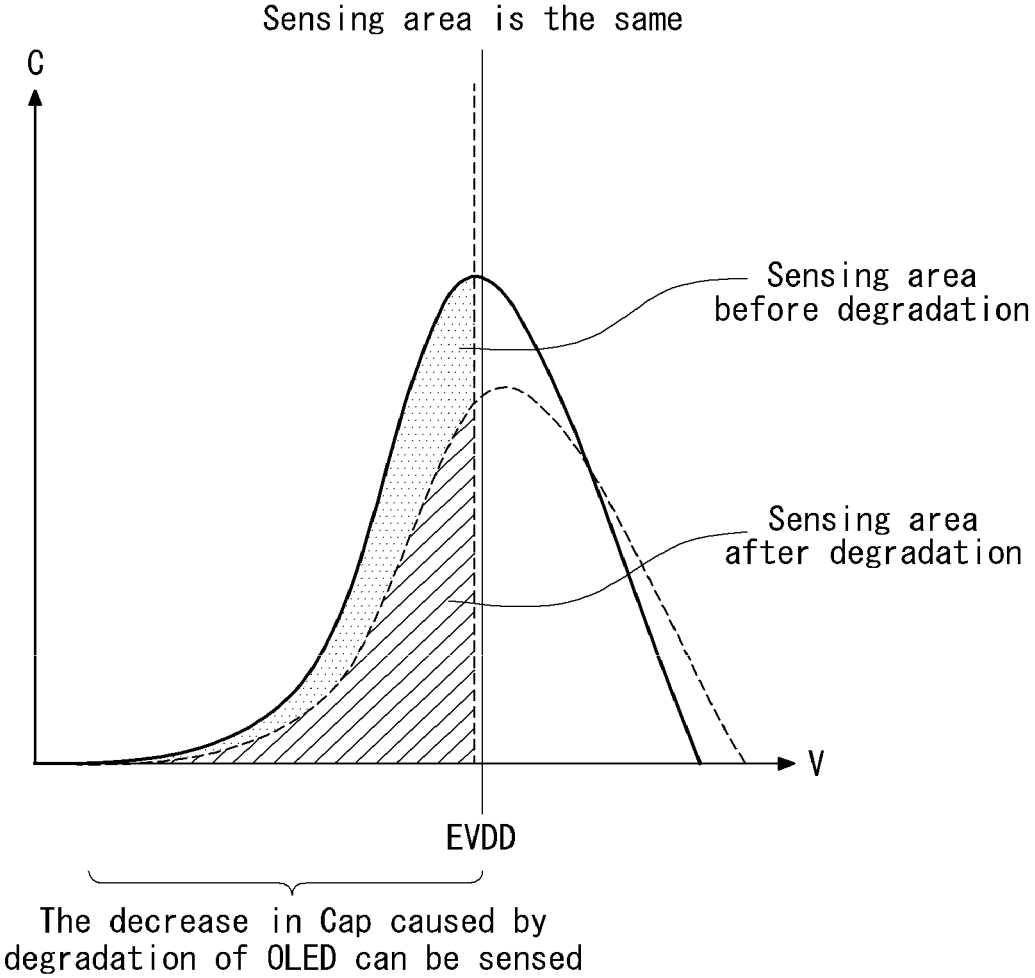

As shown in FIGS. 10, 15, and 19, the parasitic capacitance of the organic light-emitting diode is sensed (OLED Cap Sensing) (S150). The step (S150) of sensing the parasitic capacitance of the organic light-emitting diode is sensed (OLED Cap Sensing) comprises an initialization step, a charging step, and a step (OLED Cap Sensing) of sensing the parasitic capacitance of the organic light-emitting diode.

During the initialization step (Initialize), the switching transistor SW and the sensing transistor ST are turned on by a logic-high scan signal Scan and a sense signal Sense. In this step, the switching transistor SW is turned on, and the driving transistor DT is turned on by the sensing data voltage Data stored in the capacitor CST and generates a drive current. In this instance, the first sensing switch part SESW4 and the second sensing switch part SESW3 are turned off by a logic-high first sensing start signal Csw4 and a second sensing start signal Csw3.

During the charging step (Charging), the switching transistor SW and the sensing transistor ST are turned off by a logic-low scan signal Scan and a sense signal Sense. In this step, the source voltage Vs of the driving transistor DT is stored as it rises based on the applied voltage. In this instance, the first sensing switch part SESW4 and the second sensing switch part SESW3 remain turned-off by the logic-high first sensing start signal Csw4 and the second sensing start signal Csw3.

During the step (OLED Cap Sensing) of sensing the parasitic capacitance of the organic light-emitting diode, the switching transistor SW and the sensing transistor ST are turned on by the logic-high scan signal Scan. In this instance, the first sensing switch part SESW4 and the circuit initialization switch part SESW1 switch to the turned-on state by the logic-low first sensing start signal Csw4 and the circuit reset signal Csw1. Thus, the charge IsJB stored in the parasitic capacitor OLED Cap moves to the integrating capacitor CFB of the first sensing circuit part CIP through the first sensing line VREF1 based on the charge equilibrium principle. Then, the charge IsJB stored in the parasitic capacitor OLED Cap of the organic light-emitting diode is outputted as a sensed value Vout of the first sensing circuit part CIP.

Meanwhile, as the sensing data voltage Data or a compensated sensing data voltage Data' corresponding to an amount of degradation of the organic light-emitting diode OLED is applied to the first data line DL1, a voltage variation may occur (see the data voltage variation with respect to the sensed value Vs in FIG. 15). In contrast to this, the source voltage Vs is maintained in the same conditions, regardless of whether the organic light-emitting diode OLED is degraded or not.

This is because the sensing data voltage Data is compensated for in advance, in order to keep the source voltage Vs the same, regardless of whether the organic light-emitting diode OLED is degraded or not. To this end, the sensing data voltage Data should be a voltage with which the anode of the organic light-emitting diode OLED can be charged, regardless of the change before and after degradation of the organic light-emitting diode OLED. The reason why the compensated sensing data voltage Data' should be a voltage that allows the source voltage Vs to remain the same before and after degradation of the organic light-emitting diode OLED will be described below with reference to FIGS. 17 to 19.

Figure 17:
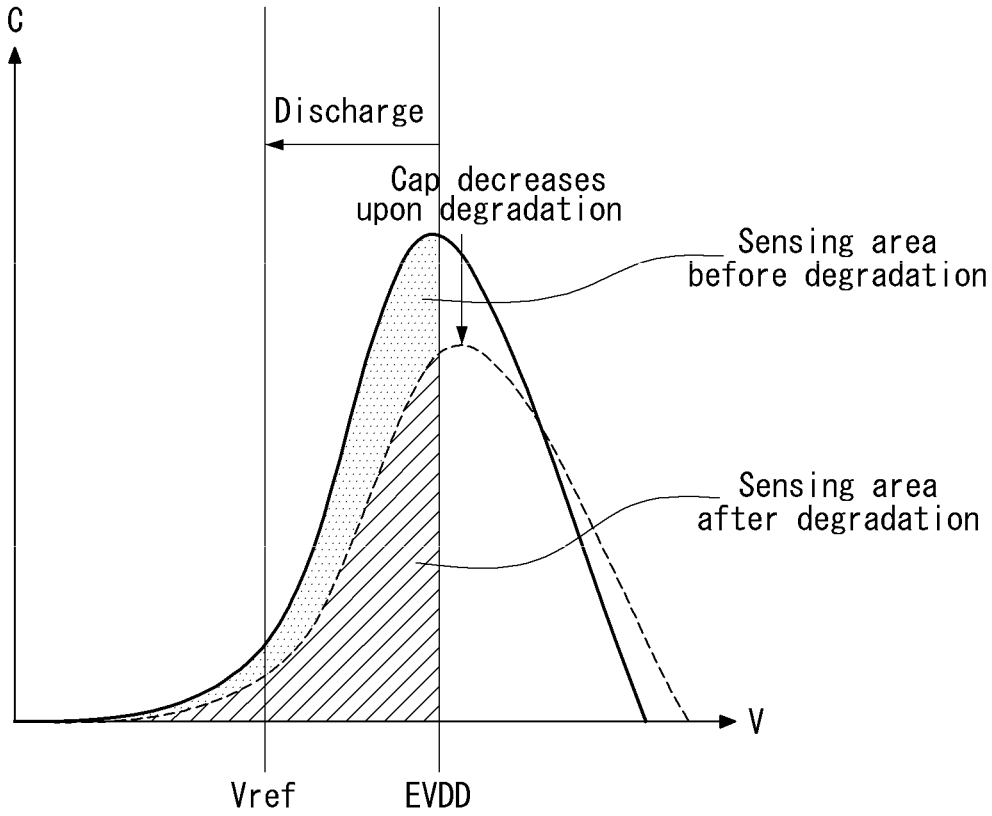
Figure 18:
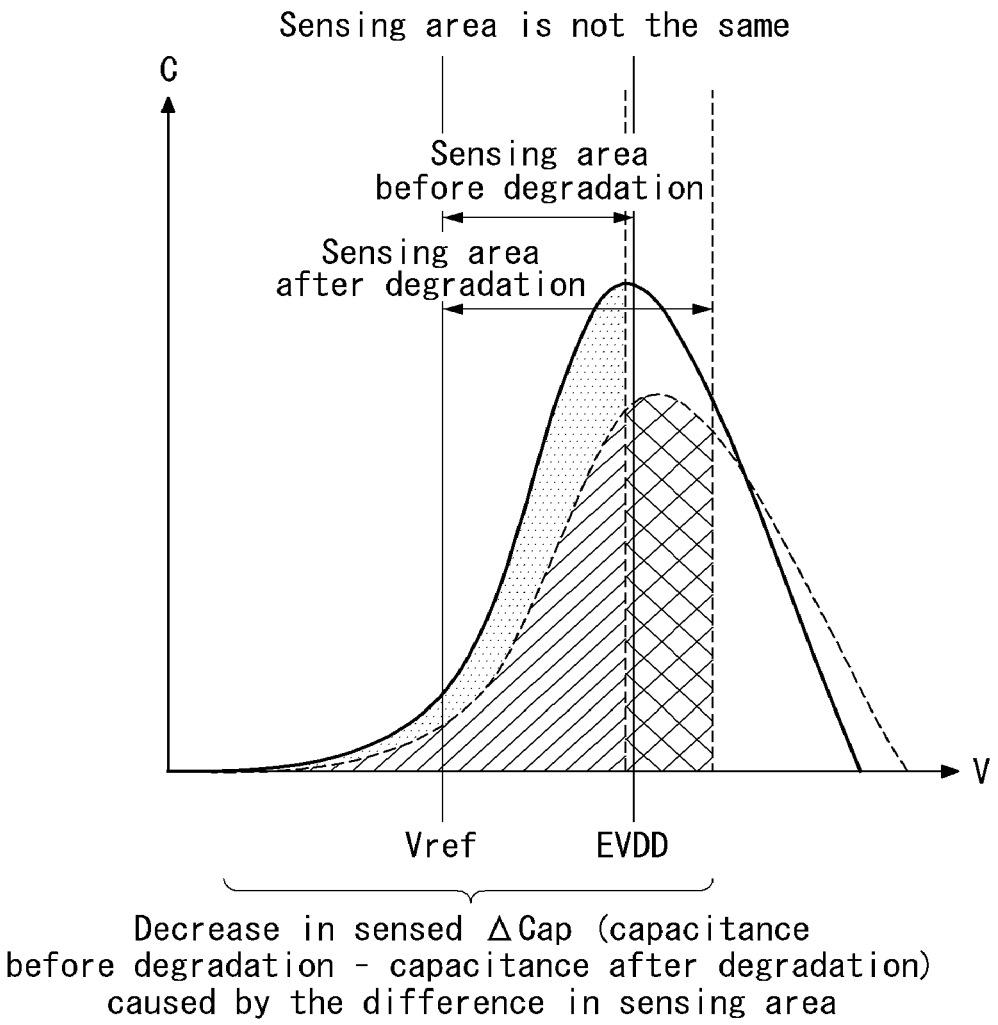

As shown in FIG. 17, as the organic light-emitting diode OLED degrades, the capacitance of the parasitic capacitor OLED Cap changes in response to this degradation. The capacitance C of the parasitic capacitor OLED Cap decreases along with the degradation of the organic light-emitting diode OLED. As shown in FIG. 18, if the capacitance of the parasitic capacitor OLED Cap decreases due to the degradation of the organic light-emitting diode OLED, the sensing area is changed (Vth shift). However, as shown in FIG. 19, the sensing area may be adjusted to be the same by reflecting a decrease in the capacitance of the parasitic capacitor OLED Cap caused by the degradation of the organic light-emitting diode OLED (so that the sensing area is under the same sensing condition regardless of degradation or under the sensing condition in which the variation in the sensing area caused by the degradation can be reduced). Thus, changes in the characteristics of the organic light-emitting diode OLED due to degradation can be accurately sensed.

To sum up, in the exemplary embodiment, a reference voltage is applied to the anode of the organic light-emitting diode OLED while the driving transistor DT is turned off, thereby causing the organic light-emitting diode OLED to emit light. Hereupon, the anode of the organic light-emitting diode goes into a floating state, and is set to an operating point voltage (corresponding to Vth) of the organic light-emitting diode OLED. Also, a discharge path is formed between the organic light-emitting diode OLED and the first sensing line VREF1 to sense a voltage change across the first sensing line VREF1 caused by a change in the operating point voltage of the organic light-emitting diode OLED.

By performing the above-described process in advance before sensing degradation of the organic light-emitting diode OLED, any effect from the driving transistor DT (for example, any variation caused by degradation of the driving transistor) can be eliminated, thereby improving the sensing accuracy and compensation accuracy of the organic light-emitting diode OLED.

The foregoing exemplary embodiments can produce better effects when applied to a second display panel based on red, green, and blue organic light-emitting diodes (e.g., soluble OLEDs), rather than to a first display panel based on white organic light-emitting diodes and color filters. This is because the red, green, and blue organic light-emitting diodes have a lower threshold voltage Vth than the white organic light-emitting diodes. Also, the second display panel has large differences in the current-voltage (IV) characteristics of the organic light-emitting diodes before and after degradation (caused by the low threshold voltage), and has variations in the sensing area before and after degradation. Due to this characteristic, the second display panel is hard to sense and compensate for degradation of the organic light-emitting diode as compared to the first display panel, so many advantages can be gained by applying this exemplary embodiments to the second display panel.

FIG. 20 is a graph showing the relationship between sensed value ΔisJB[V] and sensing range Sensing Range[V] to explain the advantage of applying an exemplary embodiment to a soluble organic light-emitting diode using, for example, inkjet technology. It will be apparent to those skilled in the art that other techniques besides inkjet technology can be applied. As can be seen from the relationship before and after compensation in FIG. 20, this exemplary embodiment provides a better resolution due to an increase (Δ increase) in the sensed value, since any effect from the driving transistor DT (for example, any variation caused by degradation of the driving transistor) can be eliminated.

FIG. 21 is a graph showing the relationship between sensed value ΔisJB[V] and sensing range Sensing Range[V] to explain the advantage of applying an exemplary embodiment to a soluble organic light-emitting diode using spin coating technology. As can be seen from the relationship before and after compensation in FIG. 21, this exemplary embodiment can improve sensing accuracy by preventing the problem of variations in the sensing area caused by differences in the characteristics of the organic light-emitting diode before and after degradation. As can be seen from the graph of the relationship before compensation, if there is a large variation in the sensing area before and after degradation of the organic light-emitting diode, the sensed value ΔisJB[V] may detected inversely, in which case it can be difficult to perform accurate compensation. However, in this exemplary embodiment, the sensing area may remain the same before and after degradation of the organic light-emitting diode, thereby enabling accurate sensing and compensation.

Figure 22:
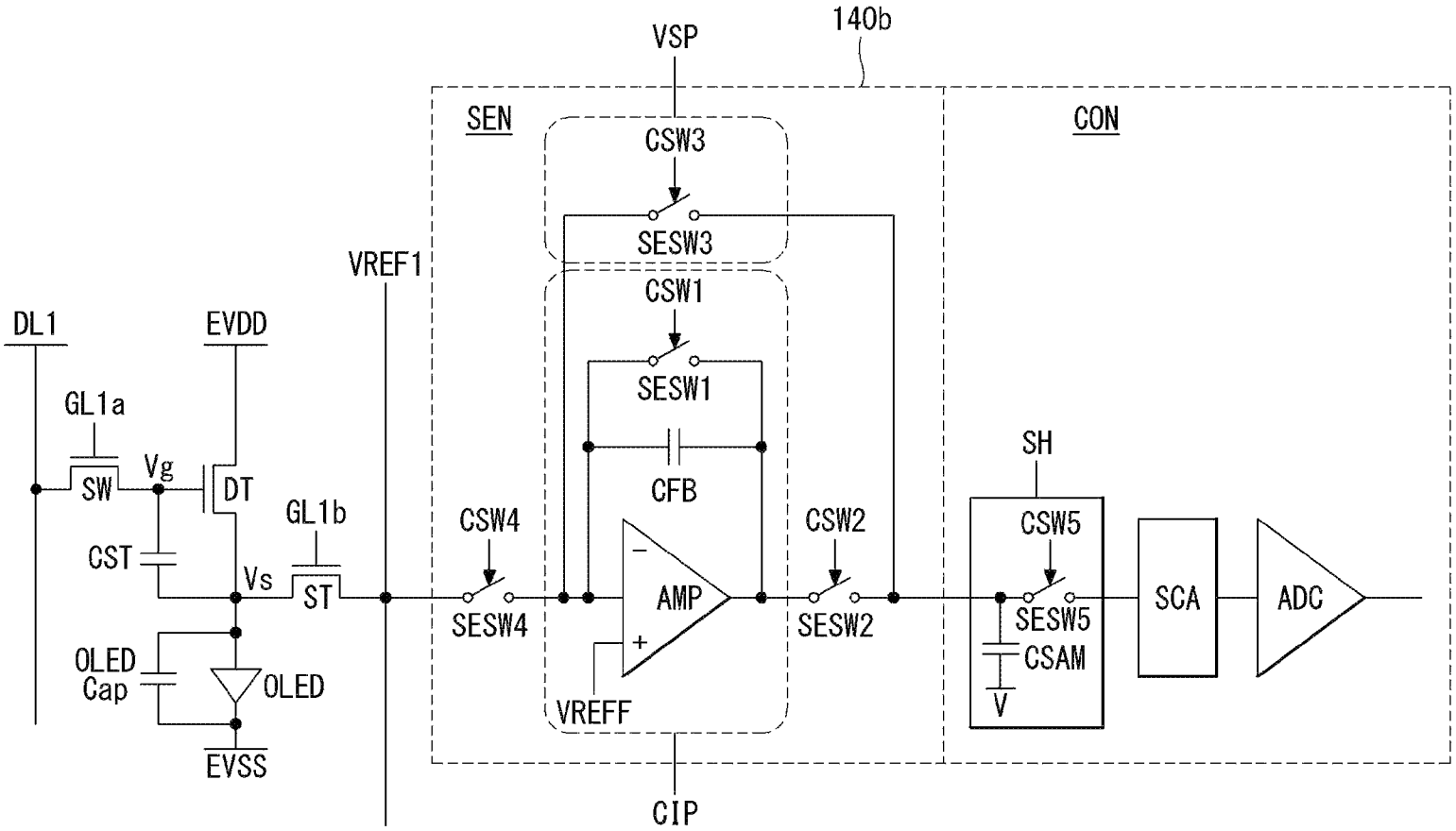
FIG. 22 is a view schematically showing an example of a second circuit of an organic light-emitting display according to one or more embodiments of the present disclosure.

FIG. 22 is a view schematically showing an example of a second circuit of an organic light-emitting display according to one or more embodiments of the present disclosure.

As shown in FIG. 22, the second circuit 140*b* of the organic light-emitting display according to one or more embodiments of the present disclosure comprises a sensing circuit part SEN for obtaining a sensed value and a sensed value conversion part CON for converting the sensed value. Although the organic light-emitting display illustrated in FIG. 22 is similar to the organic light-emitting display illustrated and described previously herein, a description thereof will be focused on the differences in the configuration of the sensed value conversion part CON.

According to another embodiment, the sensed value conversion part CON comprises a sample and hold part SH, a scaler circuit or part SCA, and an analog-to-digital conversion part ADC. The sample and hold part SH samples and holds a sensed value outputted from the sensing circuit part SEN. To this end, the sample and hold part SH comprises a sampling capacitor CSAM and a hold switch part SESW5. One end of the sampling capacitor CSAM is connected to the sensed value delivery switch part SESW2, and the other end thereof is connected to a voltage terminal V. A gate electrode of the hold switch part SESW5 is connected to a hold signal line CSW5, a first electrode thereof is connected to one end of the sampling capacitor CSAM, and a second electrode thereof is connected to an input terminal of the scaler part SCA.

The scaler part SCA removes noise components present in a sensed value outputted from the sample and hold part SH as it scales the sensed value. The analog-to-digital conversion part ADC converts an analog sensed value outputted from the scaler part SCA to a digital sensed value and outputs it. The organic light-emitting display according to some embodiments of the present disclosure may further improve sensing accuracy by scaling and converting a sensed value and removing noise left in the sensed value, based on components added to those of the foregoing exemplary embodiment.

As above, the present disclosure offers the advantage of improving display quality and lifespan by accurately sensing an amount of degradation of the organic light-emitting diode and precisely compensating for the amount of degradation. Moreover, the present disclosure offers the advantage of accurately sensing changes in the characteristics caused by degradation of the organic light-emitting diode by establishing a sensing condition reflecting a decrease in the capacitance of the parasitic capacitor caused by degradation of the organic light-emitting diode. Furthermore, the present disclosure offers the advantage of improving the sensing accuracy and compensation accuracy of the organic light-emitting diode by eliminating any effect from the driving transistor (any variation caused by degradation of the driving transistor). In addition, the present disclosure offers the advantage of overcoming the difficulties in sensing and compensating for degradation of a display panel based on soluble organic light-emitting diodes and improving compensation accuracy.

According to an example of the present disclosure, the compensation circuit determines whether the organic light-emitting diode is degraded or not, through the analysis of a voltage obtained by the first sensing operation, during the first sensing operation, a sensing data voltage corresponding to deterioration of the organic light emitting diode is outputted from the first circuit.

According to an example of the present disclosure, the sensing data voltage varies in response to a change in the voltage stored in the anode of the organic light-emitting diode.

According to an example of the present disclosure, the sensing data voltage comprises a compensated sensing data voltage which reflects a decrease in the capacitance of the parasitic capacitor of the organic light-emitting diode.

According to an example of the present disclosure, the voltage stored in the anode of the organic light-emitting diode is set to remain the same by the compensated sensing data voltage, even when the organic light-emitting diode degrades.

According to an example of the present disclosure, the second circuit comprises a first sensing circuit part which performs an operation for sensing the charge accumulated in the parasitic capacitor of the organic light-emitting diode through a first sensing switch part connected to a sensing line for the pixel, and a second sensing circuit part comprising a second sensing switch part which is connected to the first sensing switch part and performs an operation for sensing the voltage stored in the anode of the organic light-emitting diode.

According to an example of the present disclosure, the first sensing switch part is turned on during the first sensing operation, and the first sensing switch part and the second sensing switch part are turned on during the second sensing operation.

According to an example of the present disclosure, the first sensing switch part comprises a gate electrode connected to a first sensing start signal line, a first electrode connected to a first sensing line on the display panel, and a second electrode connected to an inverting terminal of an op-amp of the second circuit.

According to an example of the present disclosure, the second sensing switch part comprises a gate electrode connected to a second sensing start signal line, a first electrode connected to the second electrode of the first sensing switch part, and a second electrode connected to an input terminal of a sample and hold part of the second circuit.

According to an example of the present disclosure, the second circuit comprises a circuit initialization switch part having a gate electrode connected to a circuit initialization signal line, a first electrode connected to the inverting terminal of the op-amp, and a second electrode connected to an output terminal of the op-amp.

According to an example of the present disclosure, the second circuit comprises a sensed value delivery switch part having a gate electrode connected to an output delivery signal line, a first electrode connected to the output terminal of the op-amp, and a second electrode connected to the input terminal of the sample and hold part.

According to an example of the present disclosure, the first sensing step comprises applying a sensing data voltage through a data line of the pixel; sensing the voltage stored in the anode of the organic light-emitting diode and then determining whether the organic light-emitting diode is degraded or not, and compensating for the sensing data voltage in response to a degradation of the organic light-emitting diode, and applying a compensated sensing data voltage to the pixel.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A light-emitting display, comprising:

a display panel including a pixel having an organic light-emitting diode;

a first circuit which supplies a data voltage to the pixel;

a second circuit which performs a first sensing operation for sensing a voltage stored at an anode of the organic light-emitting diode and a second sensing operation for sensing a parasitic capacitance of the organic light-emitting diode; and a compensation circuit compensating for degradation of the organic light-emitting diode based on a sensed value outputted from the second circuit, wherein the second circuit includes:

a first sensing circuit which performs the second sensing operation for sensing the parasitic capacitance of the organic light-emitting diode through a first sensing switch coupled to a sensing line for the pixel; and a second sensing circuit including a second sensing switch which is coupled to the first sensing switch and performs the first sensing operation for sensing the voltage stored at the anode of the organic light-emitting diode, wherein both of the first and second sensing switches are turned-on during the first sensing operation for sensing the voltage stored at the anode of the organic light-emitting diode.

2. The light-emitting display of claim 1, wherein the compensation circuit further determines whether the organic light-emitting diode is degraded or not, based on an analysis of a voltage obtained by the first sensing operation, during the first sensing operation, and a sensing data voltage corresponding to deterioration of the organic light emitting diode outputted from the first circuit.

3. The light-emitting display of claim 2, wherein the sensing data voltage varies in response to a change in the voltage stored in the anode of the organic light-emitting diode.

4. The light-emitting display of claim 2, wherein the sensing data voltage includes a compensated sensing data voltage which reflects a change in the parasitic capacitance of the organic light-emitting diode.

5. The light-emitting display of claim 4, wherein the voltage stored at the anode of the organic light-emitting diode is set to remain the same by the compensated sensing data voltage, even when the organic light-emitting diode degrades.

6. The light-emitting display of claim 1, wherein the first sensing switch is turned on during the first sensing operation.

7. The light-emitting display of claim 1, further comprising an amplifier having a first input and a second input, wherein the first sensing switch includes a gate electrode connected to a first sensing start signal line, a first electrode connected to a first sensing line on the display panel, and a second electrode connected to the first input of the amplifier of the second circuit.

8. The light-emitting display of claim 7, further comprising a sample and hold circuit, wherein the second sensing switch includes a gate electrode connected to a second sensing start signal line, a first electrode connected to the second electrode of the first sensing switch, and a second electrode connected to an input terminal of the sample and hold circuit of the second circuit.

9. The light-emitting display of claim 8, wherein the second circuit includes a circuit initialization switch having a gate electrode connected to a circuit initialization signal line, a first electrode connected to the first input of the amplifier, and a second electrode connected to an output terminal of the amplifier.

10. The light-emitting display of claim 9, wherein the second circuit includes a sensed value delivery switch having a gate electrode connected to an output delivery signal line, a first electrode connected to the output terminal of the amplifier, and a second electrode connected to the input terminal of the sample and hold circuit.

* * * * *